US012565374B1

(12) United States Patent
Romero et al.

(10) Patent No.: US 12,565,374 B1
(45) Date of Patent: Mar. 3, 2026

(54) PACKAGING FOR GOLF CLUBS

(71) Applicant: Topgolf Callaway Brands Corp., Carlsbad, CA (US)

(72) Inventors: Manuel Romero, Monterrey (MX); Gerardo Sagaon, Monterrey (MX)

(73) Assignee: Callaway Golf Company, Carlsbad, CA (US)

( * ) Notice: Subject to any disclaimer, the term of this patent is extended or adjusted under 35 U.S.C. 154(b) by 216 days.

(21) Appl. No.: 18/228,175

(22) Filed: Jul. 31, 2023

Related U.S. Application Data

(60) Provisional application No. 63/521,585, filed on Jun. 16, 2023.

(51) Int. Cl.
*B65D 5/50* (2006.01)
*B65D 5/32* (2006.01)
*B65D 85/20* (2006.01)

(52) U.S. Cl.
CPC ..... *B65D 85/20* (2013.01); *B65D 5/32* (2013.01)

(58) Field of Classification Search
CPC ..... B65D 85/20; B65D 5/32; B65D 5/504
USPC ..... 206/315.2
See application file for complete search history.

(56) References Cited

U.S. PATENT DOCUMENTS

| | | | | |
|---|---|---|---|---|
| 2,289,619 | A * | 7/1942 | Anderson, Jr. | B65D 5/504 211/70.1 |
| 4,887,817 | A | 12/1989 | Pelc | |
| 5,971,265 | A | 10/1999 | Collins | |
| 6,059,180 | A | 5/2000 | Collins | |
| 9,120,593 | B2 | 9/2015 | Mena et al. | |
| 10,233,005 | B1 | 3/2019 | De Bonet | |
| 10,251,503 | B1 | 4/2019 | Fulps | |
| 11,161,646 | B1 | 11/2021 | Parrish et al. | |
| 2020/0207506 | A1 | 7/2020 | Lopez Masague | |

* cited by examiner

*Primary Examiner* — Andrew D Perreault
(74) *Attorney, Agent, or Firm* — Michael A. Catania

(57) ABSTRACT

A packaging box for golf clubs is disclosed herein. The box comprises a body comprising a plurality of walls defining an elongated hollow interior, and divider inserts. The divider inserts allow for iron-type golf clubs to be packaged without the need for a full length plastic bag.

4 Claims, 20 Drawing Sheets

PACKAGING FOR GOLF CLUBS

CROSS REFERENCES TO RELATED APPLICATIONS

The Present Application claims priority to U.S. Provisional Patent Application No. 63/521,585, filed on Jun. 16, 2023, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to packaging for golf clubs. More specifically, the present invention relates to packaging for iron-type golf clubs.

Description of the Related Art

The prior art discloses various boxes for golf clubs.

Current boxes for irons require that each iron of a set be placed within a plastic bag to prevent damage to the club.

BRIEF SUMMARY OF THE INVENTION

One aspect of the present invention is a box for a set of iron-type golf clubs. The box comprises a body comprising a plurality of walls defining an elongated hollow interior, and separator panels. A first separator panel extends less than halfway along a long axis of the body from a first end of the body. The first separator panel is positioned midway between a width of the elongated hollow interior of body. The second separator panel extends less than halfway along a long axis of the body from a second end of the body. The second end opposes the first end. The second separator panel is positioned midway between the width of the elongated hollow interior of body. A plurality of iron-type golf clubs is positioned within the elongated hollow interior and separated by the first separator panel and the second separator panel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 19:
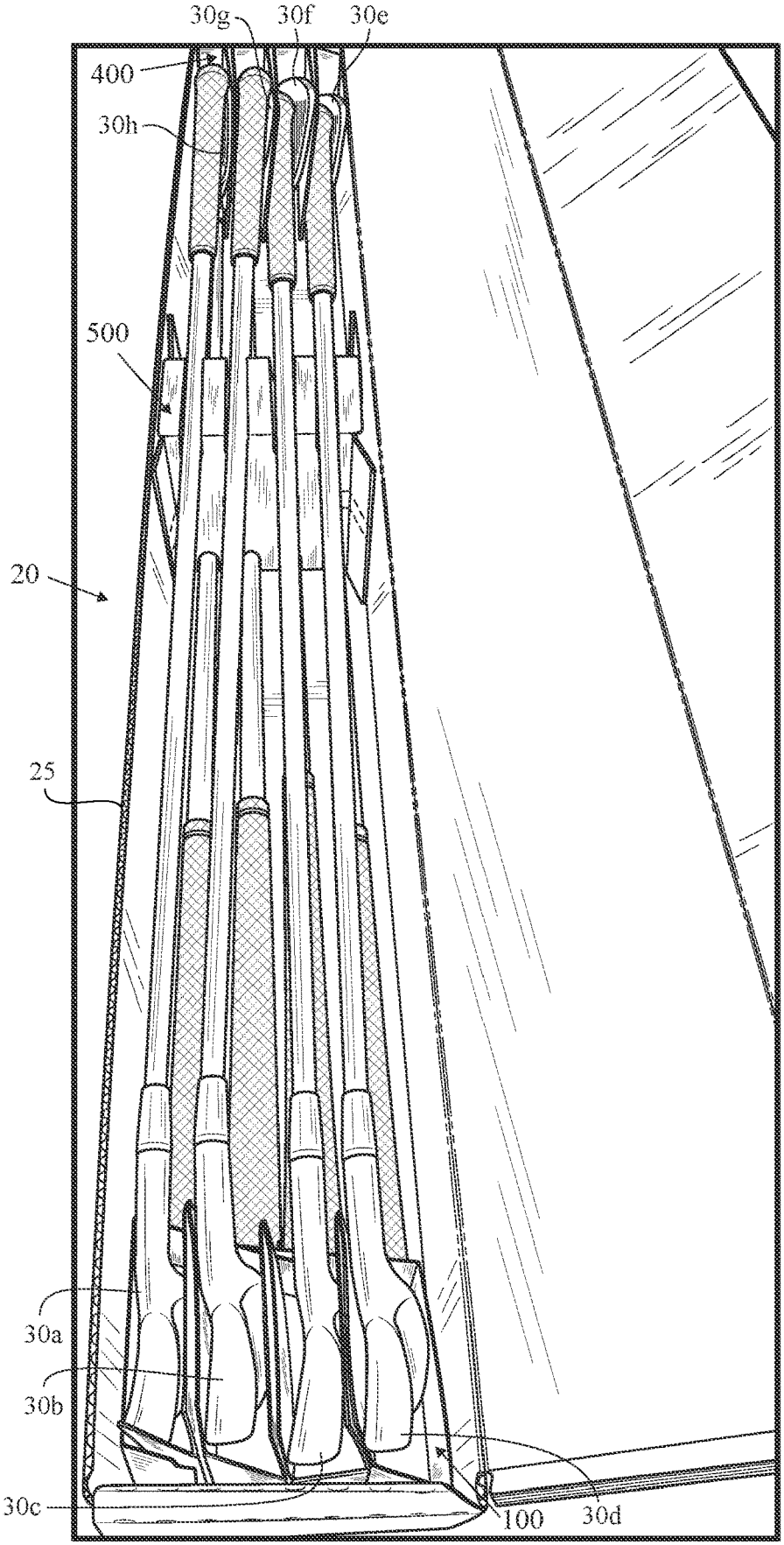
FIG. 19 is a top perspective view of an open box with the first lateral divider, the second lateral divider and the central divider placed therein, and a full set of irons positioned within the first lateral divider, the second lateral divider and the central divider.
Figure 20:
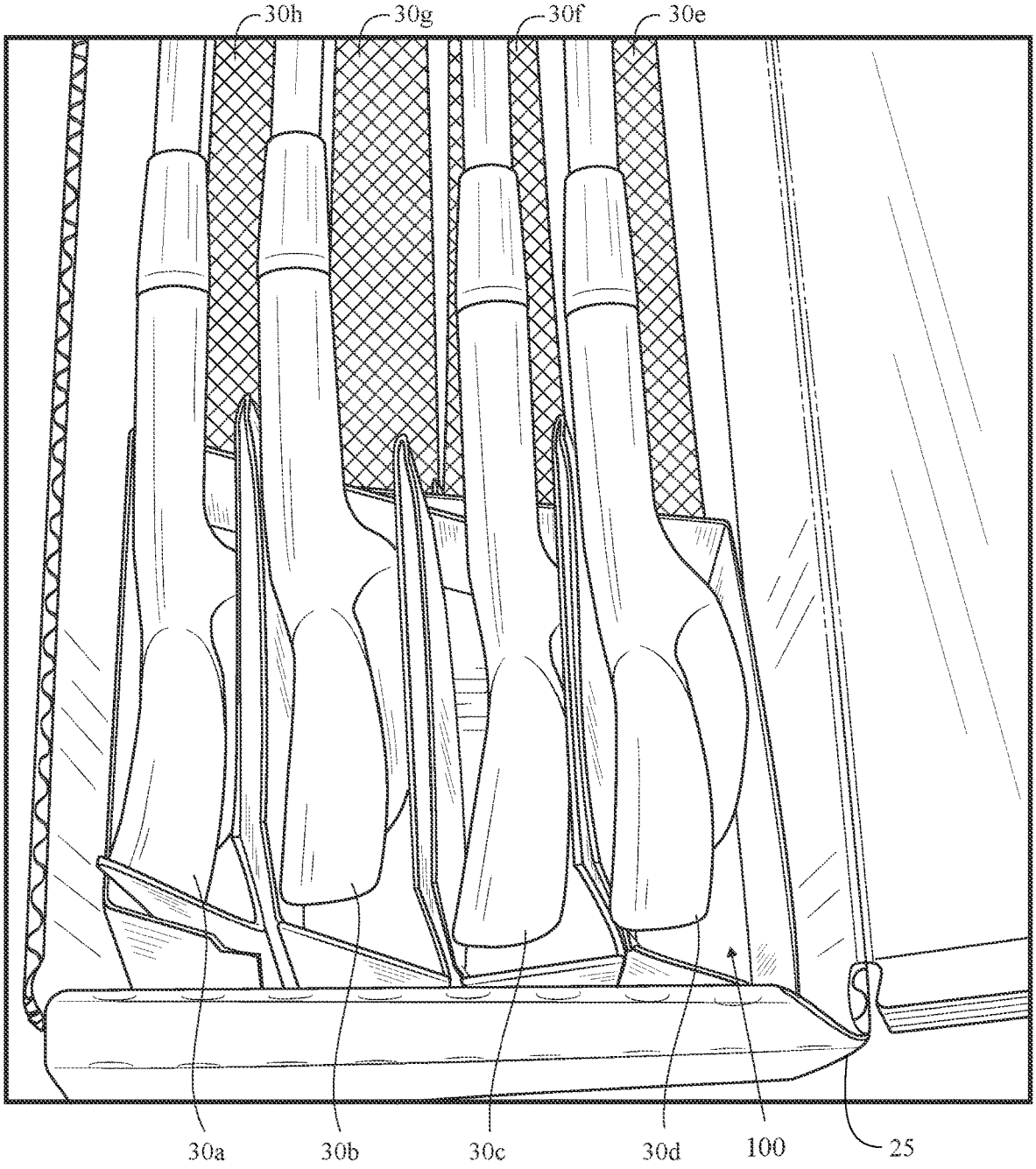
FIG. 20 is an isolated top perspective view of an open box with the second lateral divider placed therein, and a full set of irons positioned within the second lateral divider.

A box 20 for packaging set of iron-type golf clubs 30 is shown in FIGS. 19-20.

The box 20 has dividers 100, 400 and 500 that allow for secure placement of iron-type golf clubs 30 without the need for each club to be placed within a plastic bag to prevent damage to the clubs 30. Thus, the box 20 of the present invention reduces the amount of plastic used in packaging of sets of iron-type golf clubs 30 and also reduces the mass of the packaging.

Figure 1:
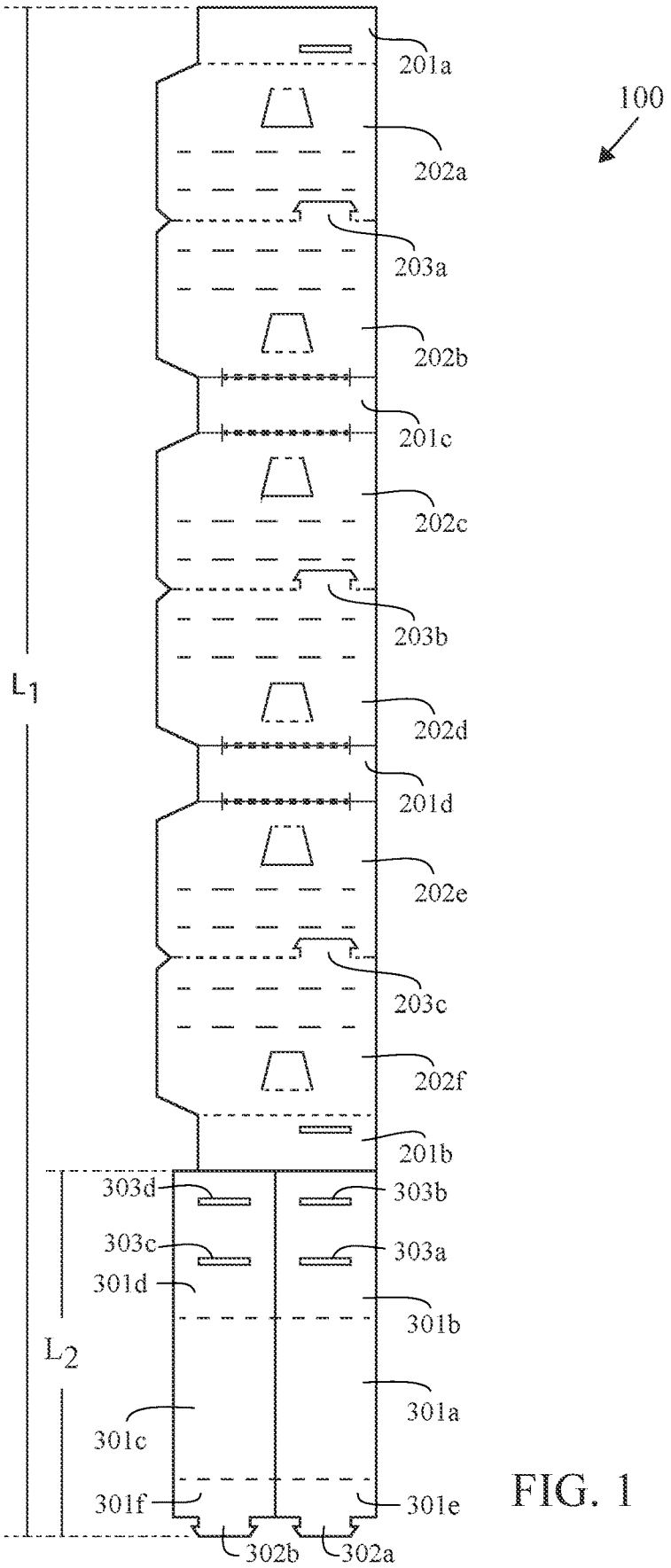
FIG. 1 is a top plan view of a blank for a first lateral divider for a box for irons.
Figure 2:
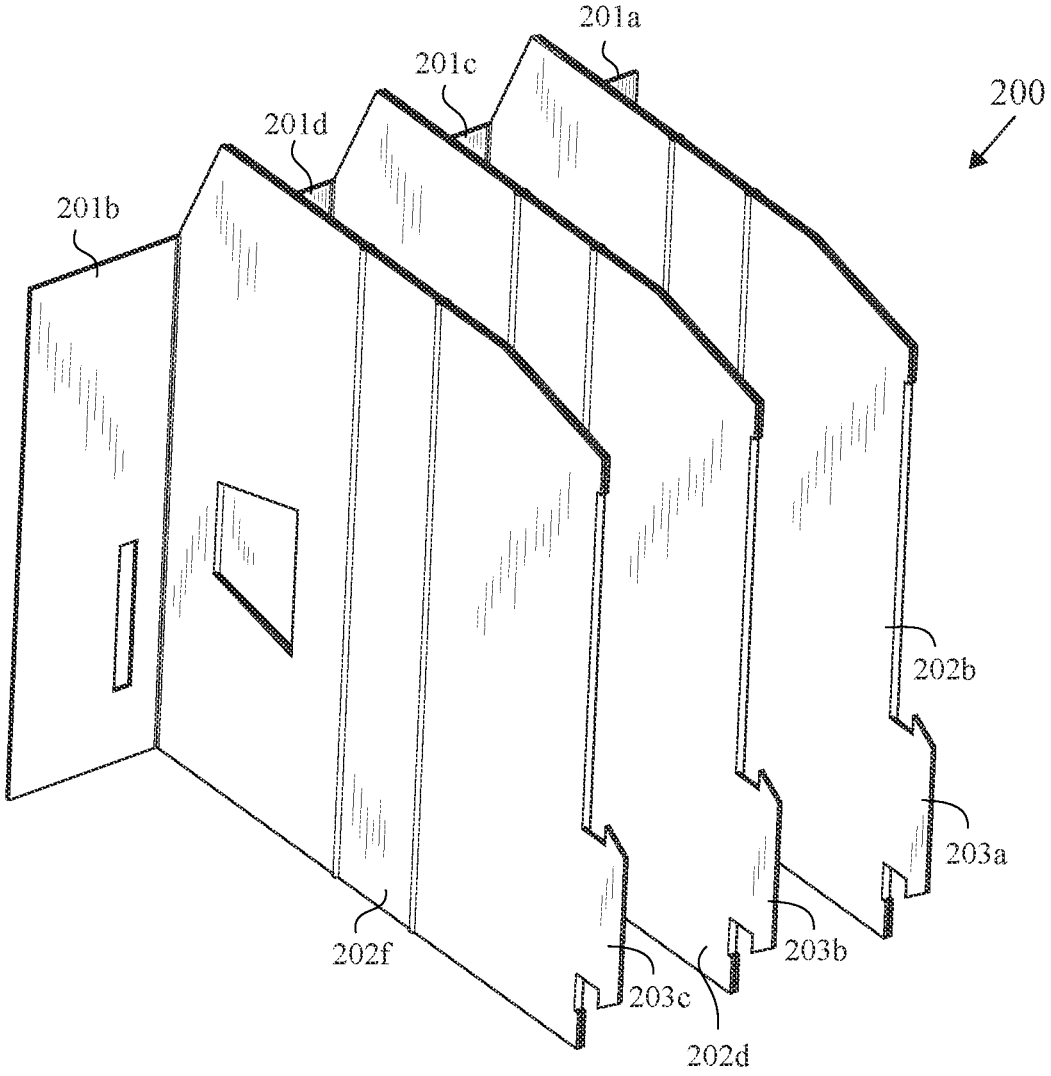
FIG. 2 is a top perspective view of a partially constructed first part of the first lateral divider.
Figure 3:
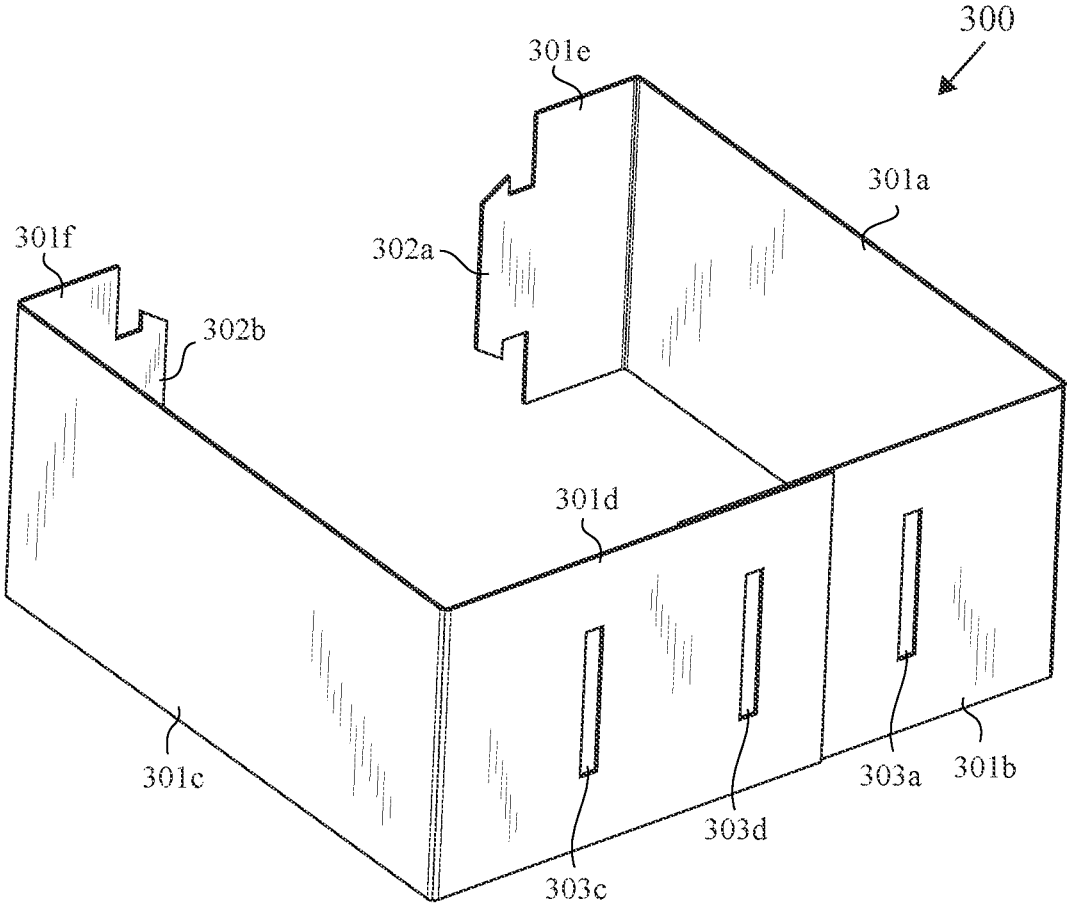
FIG. 3 is a top perspective view of a partially constructed second part of the first lateral divider.

FIGS. 1-6 illustrate a first lateral divider 100. The first lateral divider 100 is comprised of two inserts, which comprises back panel walls, central panel walls, and external panel walls. FIG. 2 illustrates the first insert 200 assembled, comprised of rear panels 201*a*-201*d*, central panels 202*a*-202*f*, and three locks 203*a*-203*c*. FIG. 3 illustrates the second insert 300 with slots 303*b* and 303*d* aligned, comprised of exterior panels 301*a*-301*f*, two locks 302*a*-302*b*, and lock slots 303*a*-303*d*. As shown in FIG. 1, L1 has a length ranging from 25 to 40 inches, more preferably from 28 to 35 inches, and most preferably approximately 30 inches. L2 has a length ranging from 4 to 12 inches, more preferably from 5 to 9 inches, and most preferably approximately 7 inches. A width is preferably 3 to 5 inches and most preferably 4.25 inches. Each central panel 202 has a length ranging from 2.5 to 3.5 inches, and most preferably 3.25 inches. Each rear panel 201 preferably has a length ranging from 0.75 inch to 1.5 inches, and most preferably 1.125 inch.

Figure 4:
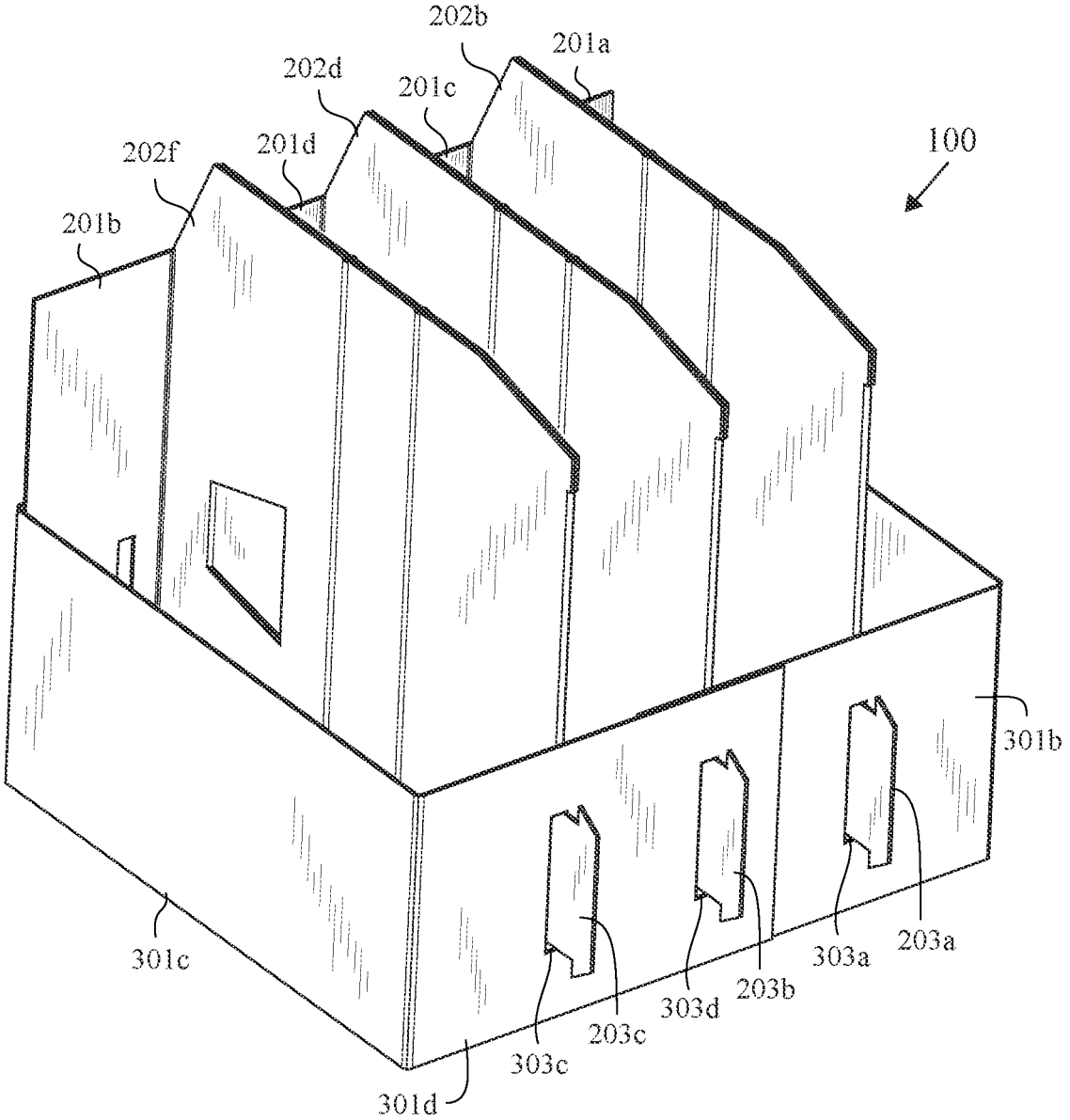
FIG. 4 a front top perspective view of the first lateral divider for the box for irons.
Figure 5:
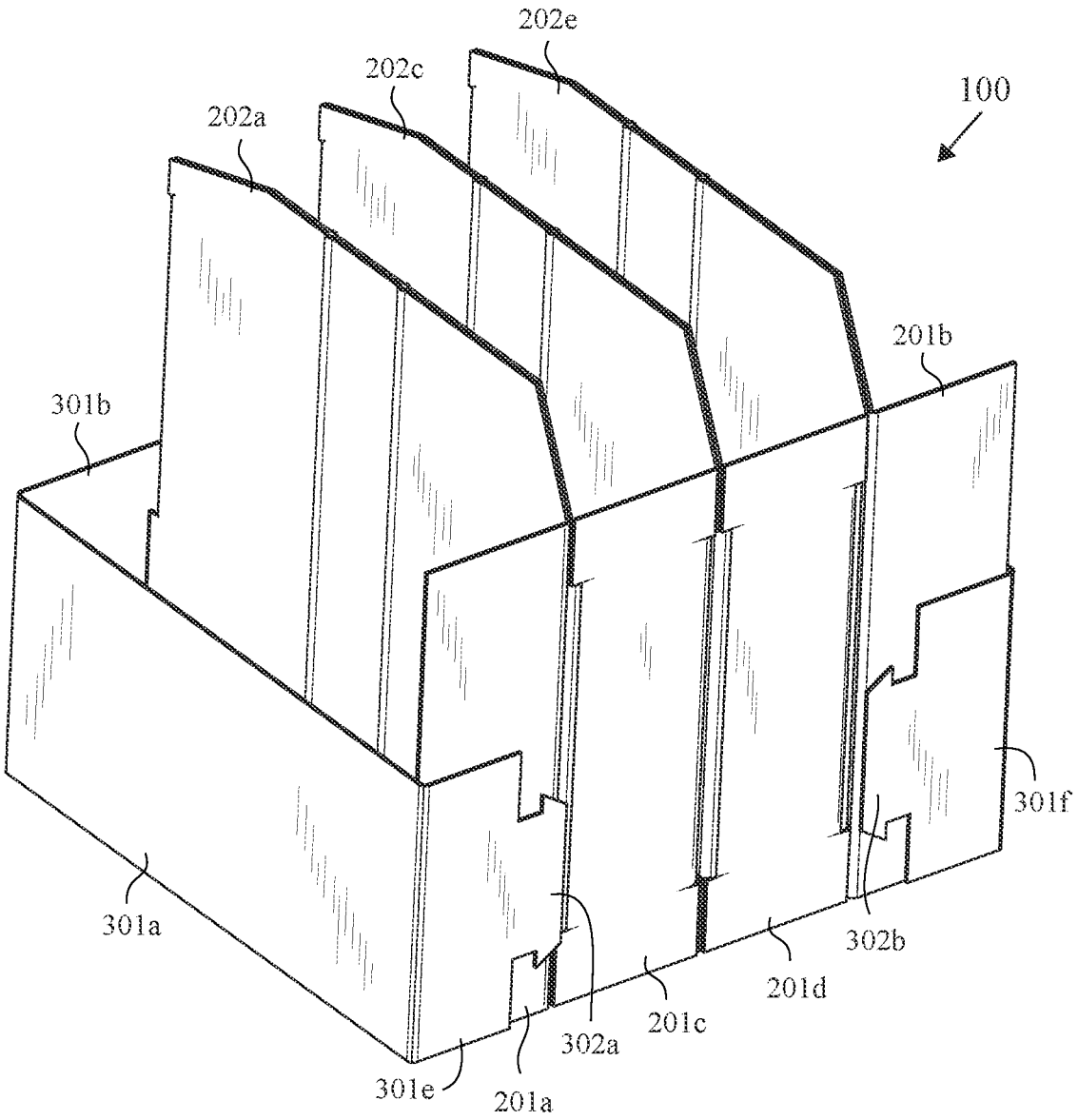
FIG. 5 a rear top perspective view of the first lateral divider for the box for irons.

The front of the insert has 3 locks that snap together and the back has 2 locks that snap together for structure. FIG. 4 illustrates the front side of the first lateral divider 100 assembled, with locks 203*a*-203*c* from the first insert 200 engaged in the slots 303*a*-303*c* of the second insert 300. FIG. 5 illustrates the back side of the first lateral divider 100 assembled, with locks 302*a*-*b* not yet tucked in.

Figure 6:
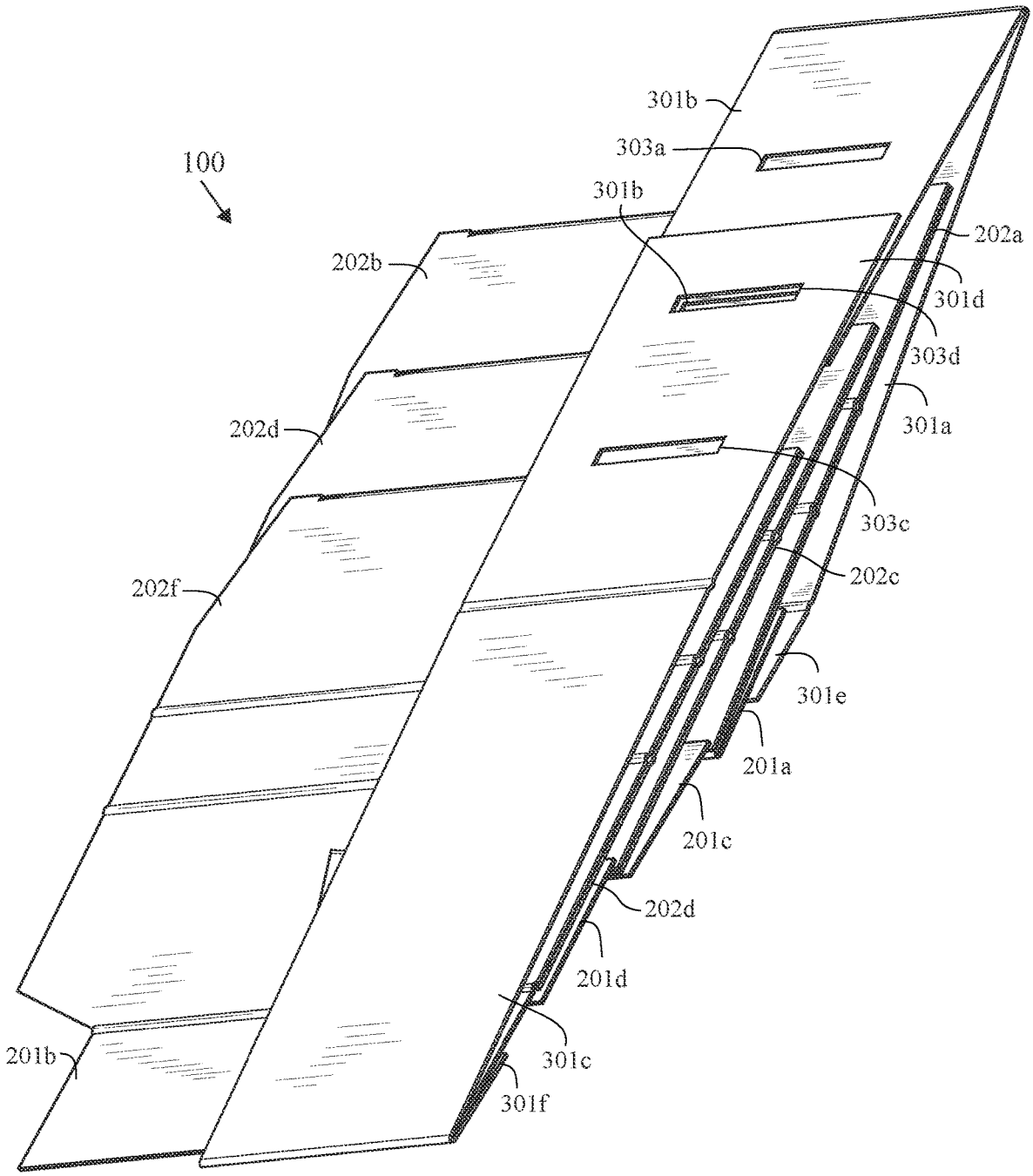
FIG. 6 is a top perspective view of the first lateral divider for a box for irons.

FIG. 6 illustrates the first lateral divider 100 assembled and collapsed.

Figure 7:
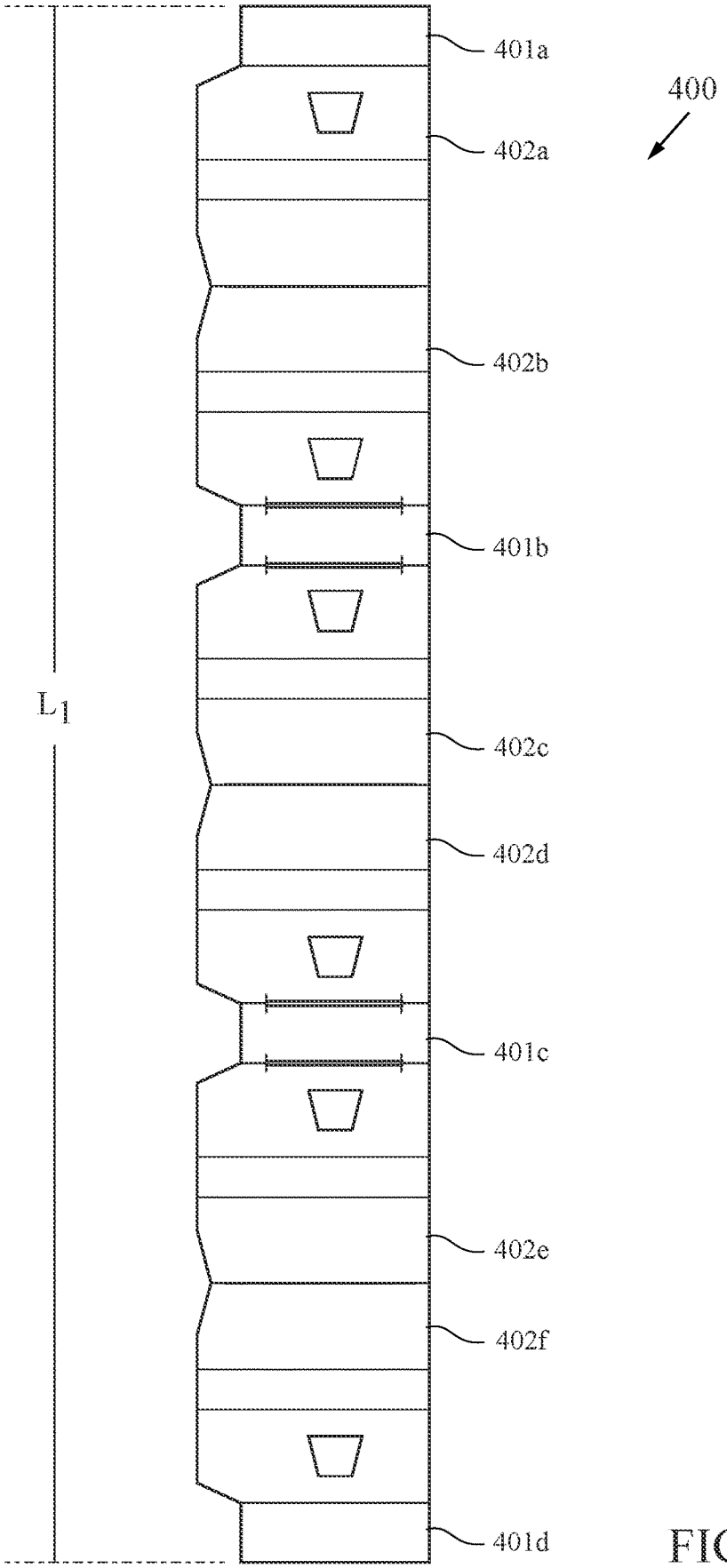
FIG. 7 is a top plan view of a blank for the second lateral divider for the box for irons.
Figure 8:
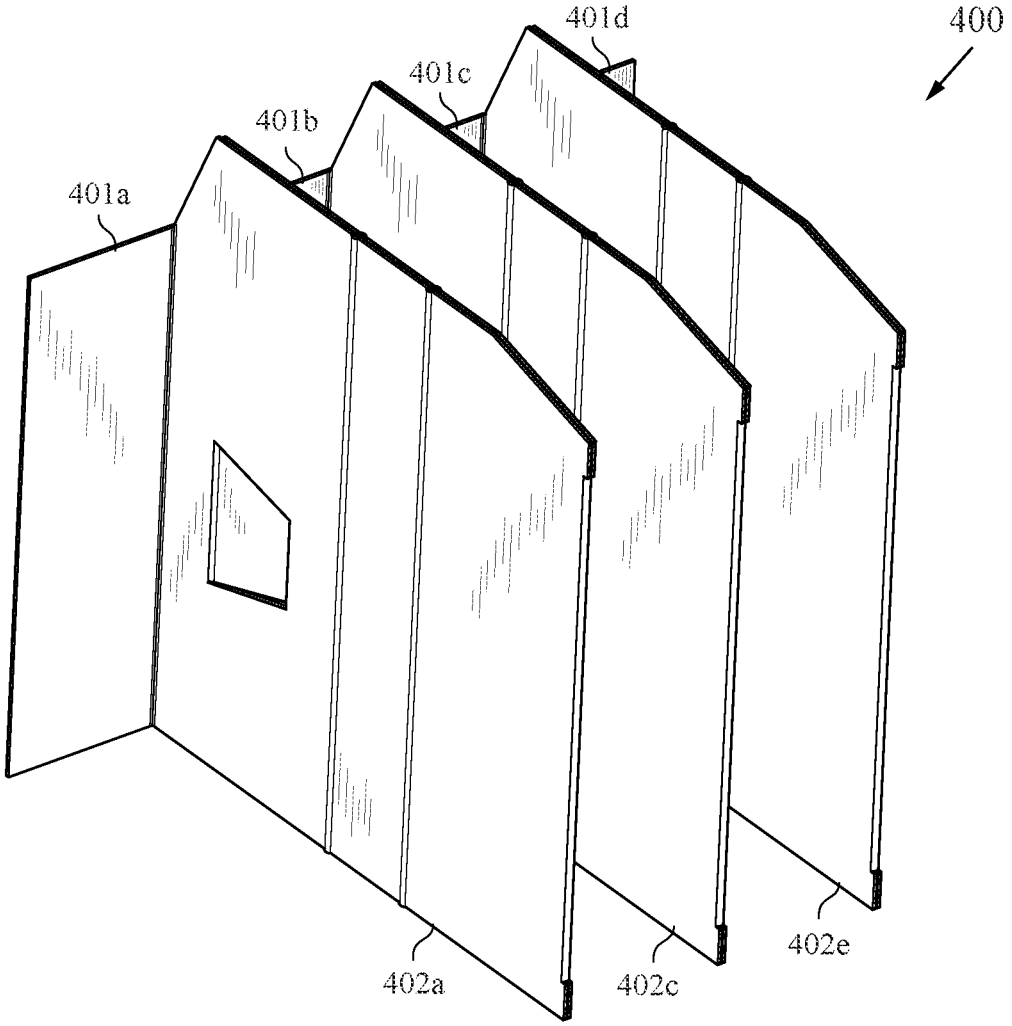
FIG. 8 is a front top perspective view of the second lateral divider for the box for irons.
Figure 9:
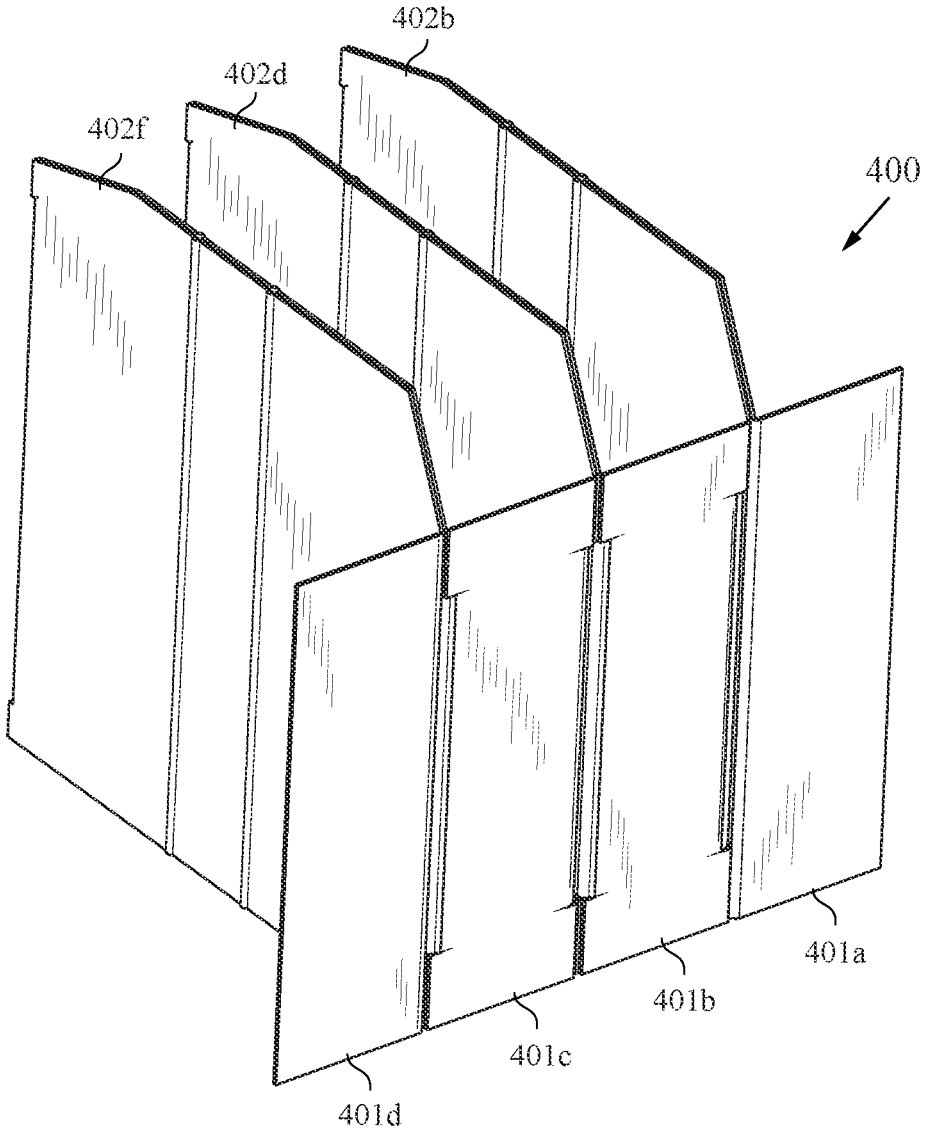
FIG. 9 is a rear top perspective view of the second lateral divider for the box for irons.
Figure 10:
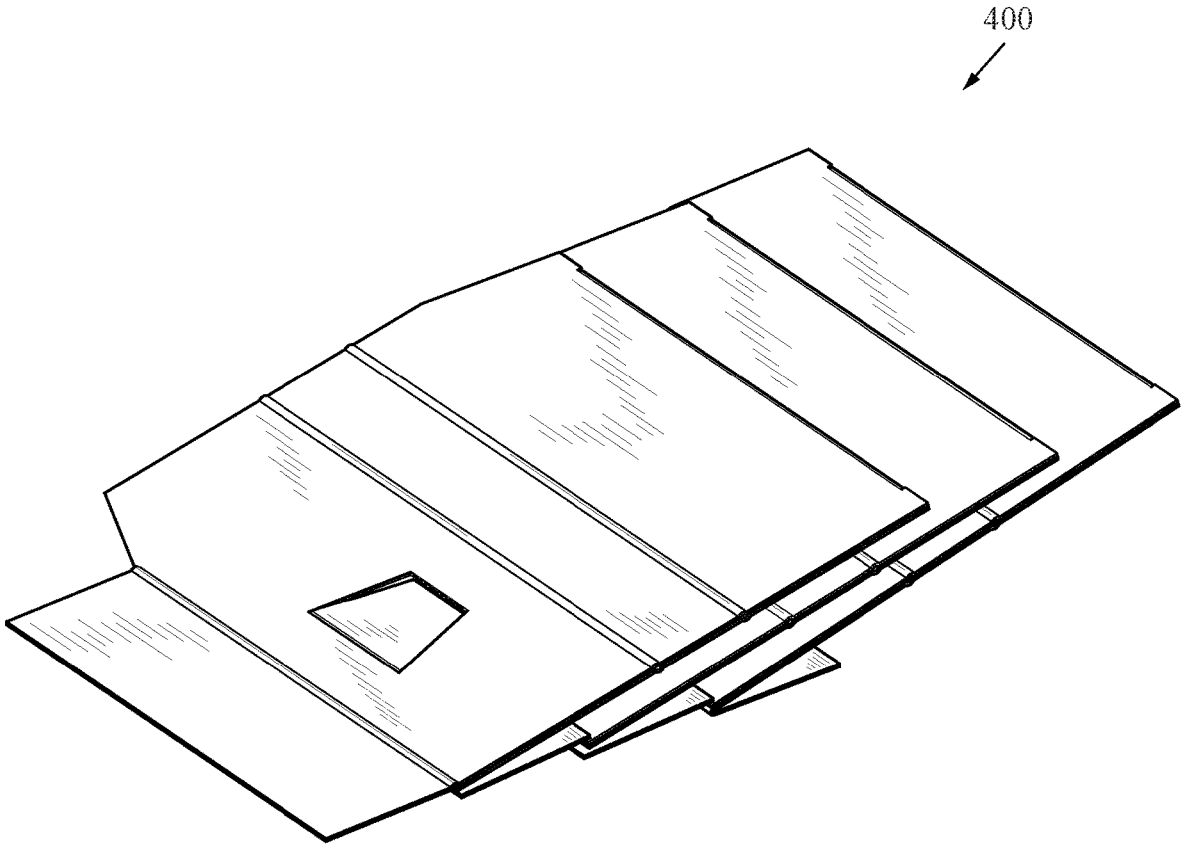
FIG. 10 is a top perspective view of the second lateral divider for a box for irons.
Figure 11:
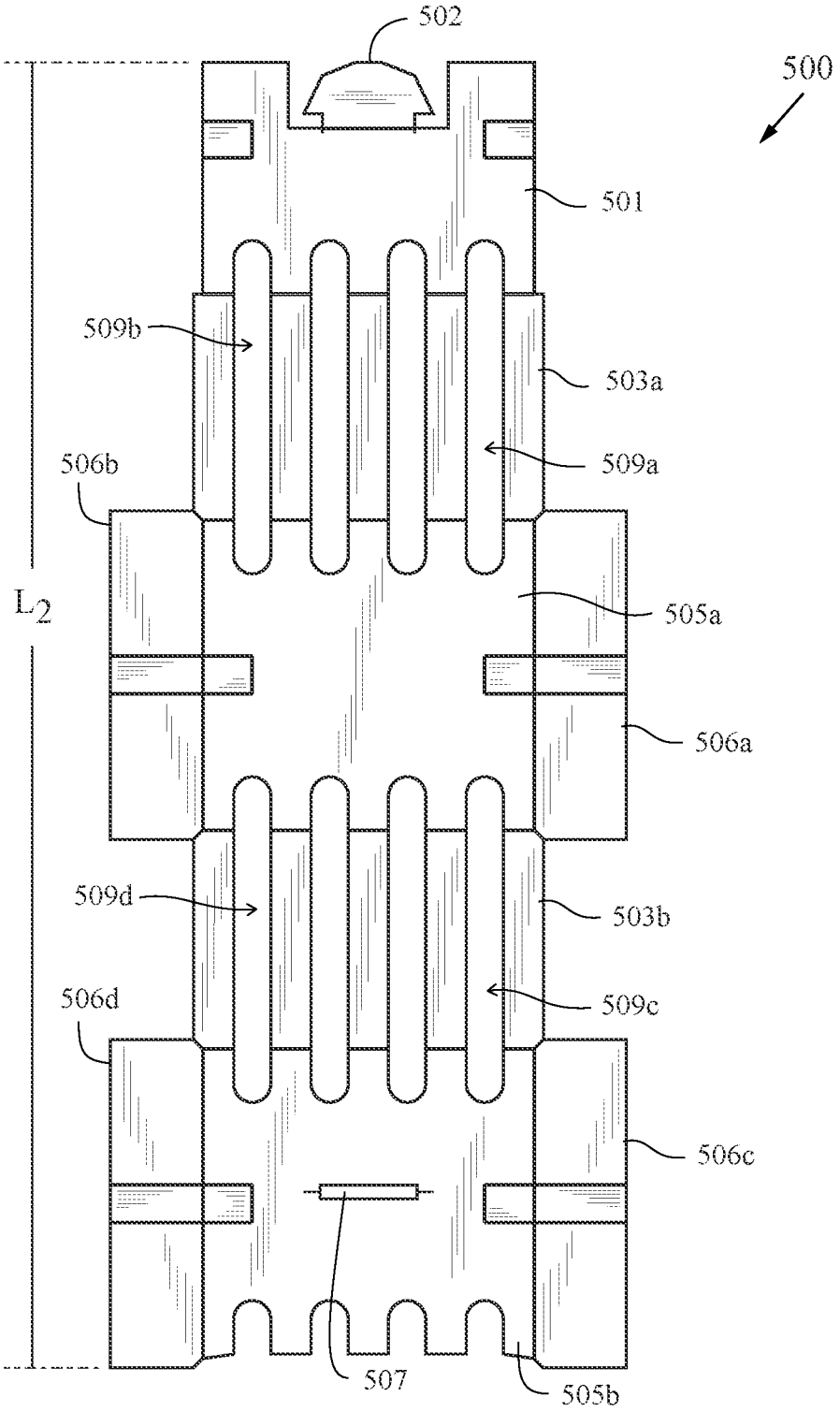
FIG. 11 is a top plan view of a blank for a central divider for the box for irons.
Figure 12:
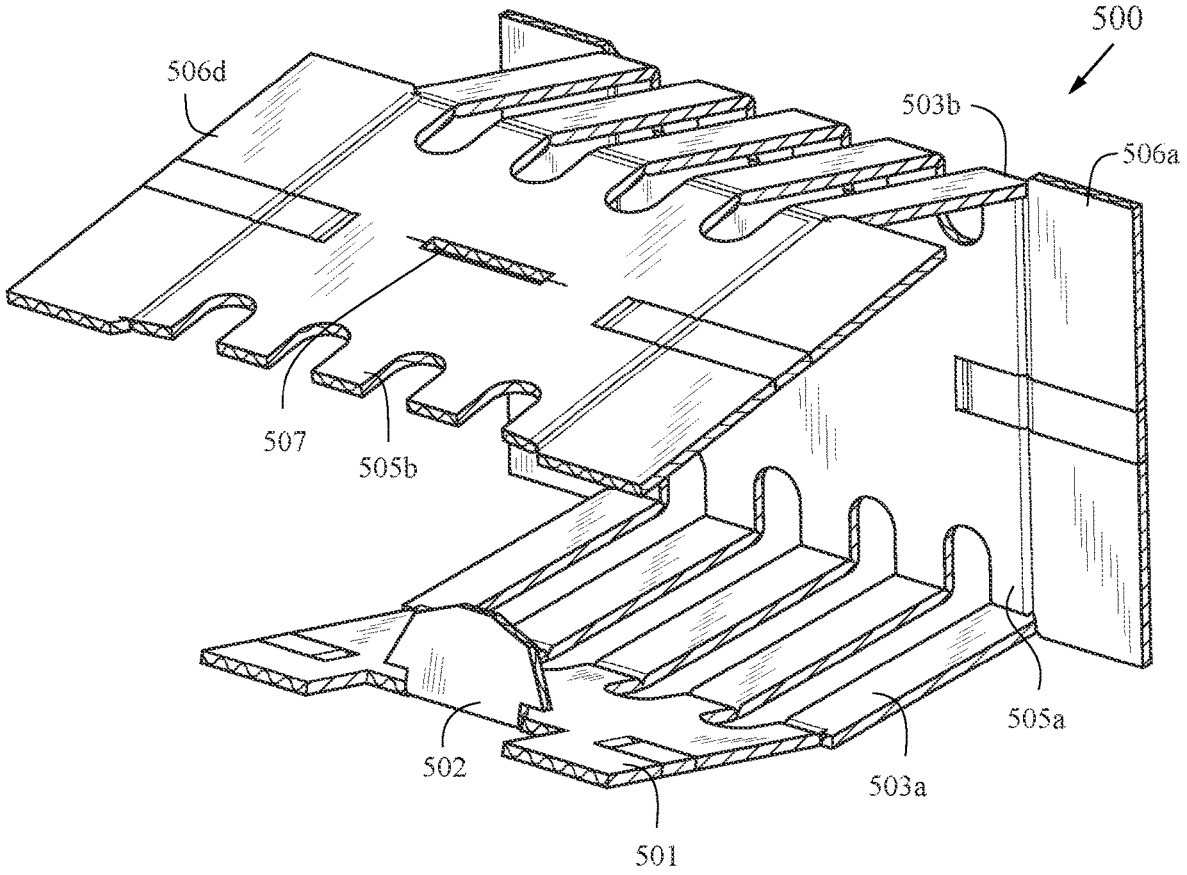
FIG. 12 is a top perspective view of a partially constructed central divider.
Figure 13:
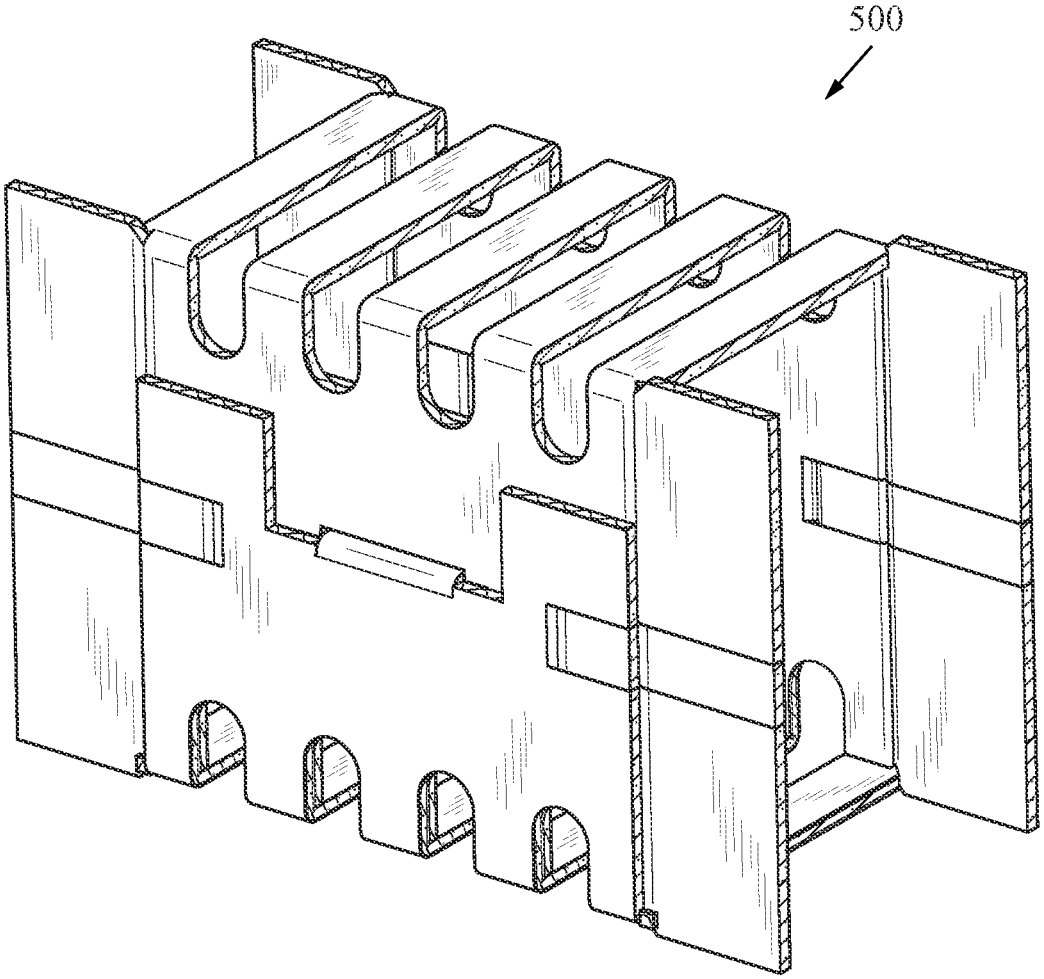
FIG. 13 is a top perspective view of the central divider for the box for irons.
Figure 14A:
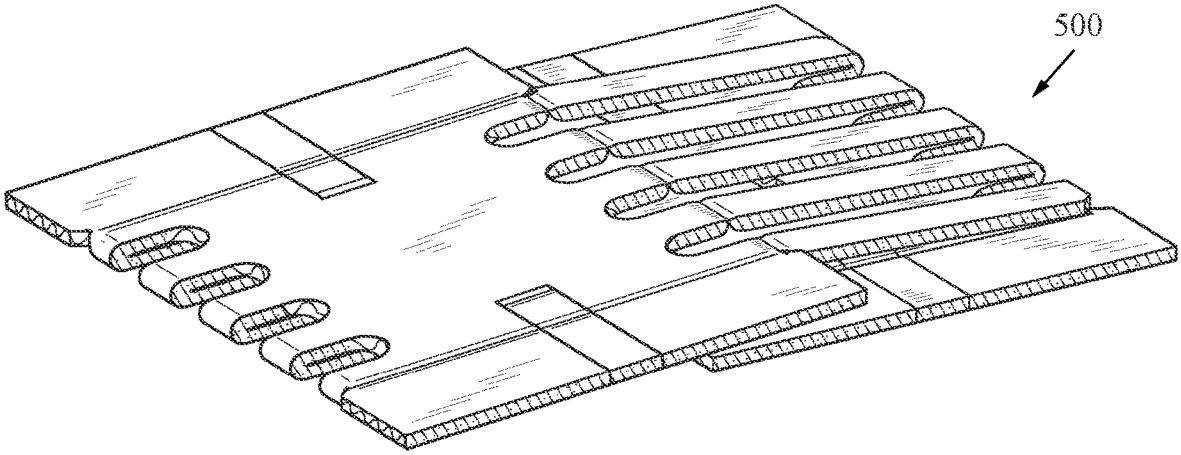
FIG. 14A is a top perspective view of a folded central divider for the box for irons.
Figure 14B:
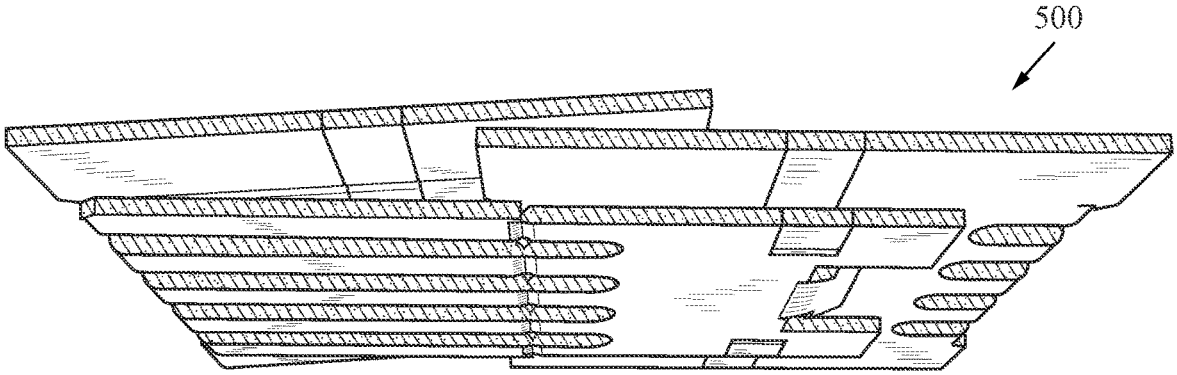
FIG. 14B is a top perspective view of a folded central divider for the box for irons.
Figure 14C:
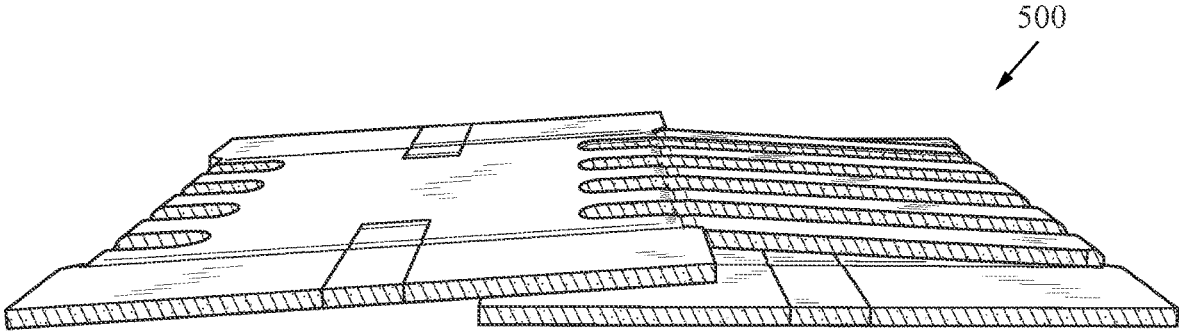
FIG. 14C is a top perspective view of a folded central divider for the box for irons.

FIG. 7-10 illustrate a second lateral divider 400. The second lateral divider 400 comprises of back panels 401*a*-401*d* and central panels 402*a*-402*f*. The second lateral divider 400 is shown assembled and collapsed in FIG. 10. As shown in FIG. 7, L1 has a length ranging from 25 to 40 inches, more preferably from 28 to 35 inches, and most preferably approximately 29 inches. A width is preferably 3 to 5 inches and most preferably 4.25 inches. Each central panel 402 has a length ranging from 3 to 5 inches, and most preferably approximately 4 inches. Each back panel 401 preferably has a length ranging from 0.75 inch to 1.5 inches, and most preferably 1.125 inch.

Figure 15:
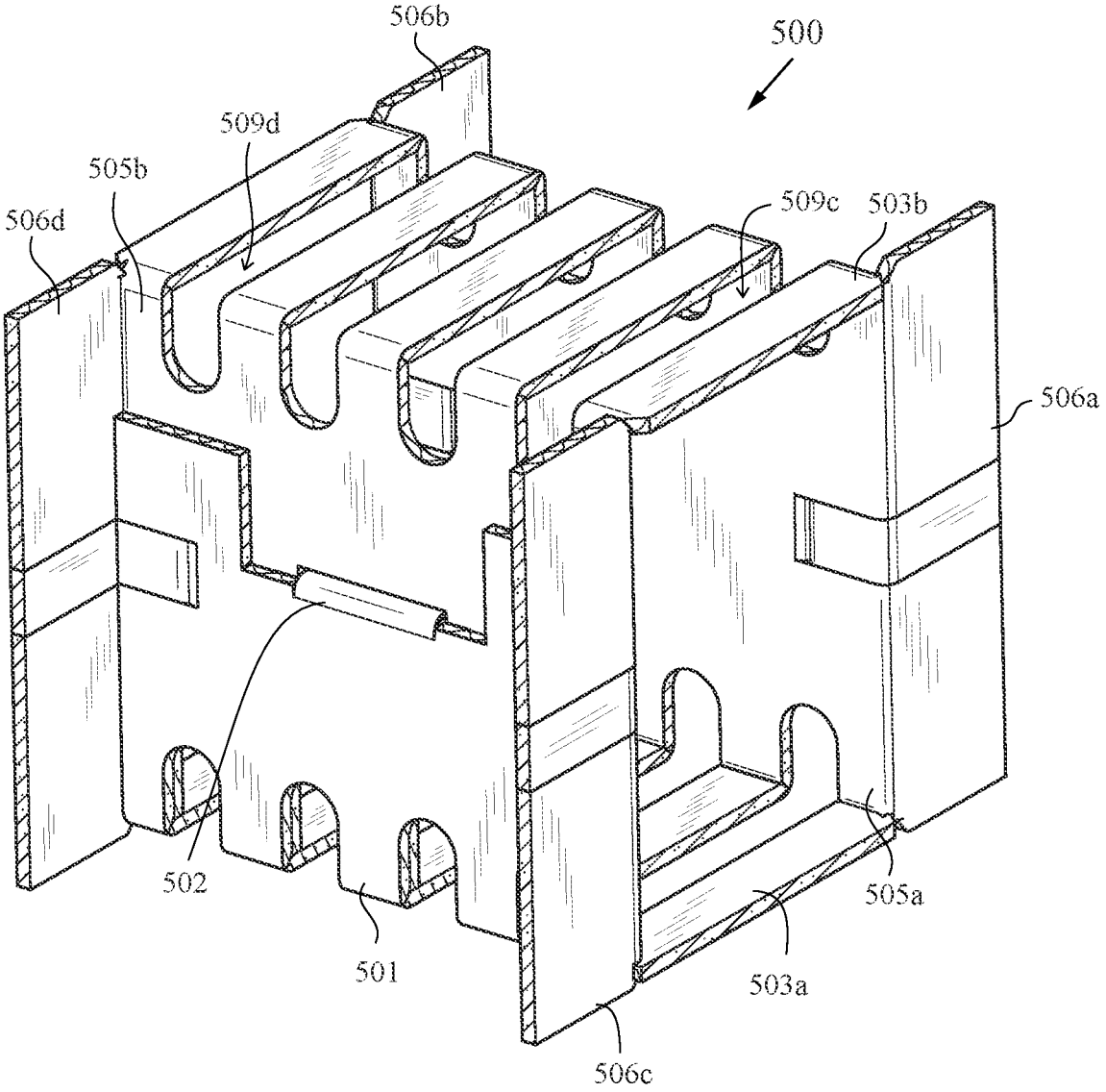
FIG. 15 is a top perspective view of the central divider for the box for irons for eight pieces.
Figure 16:
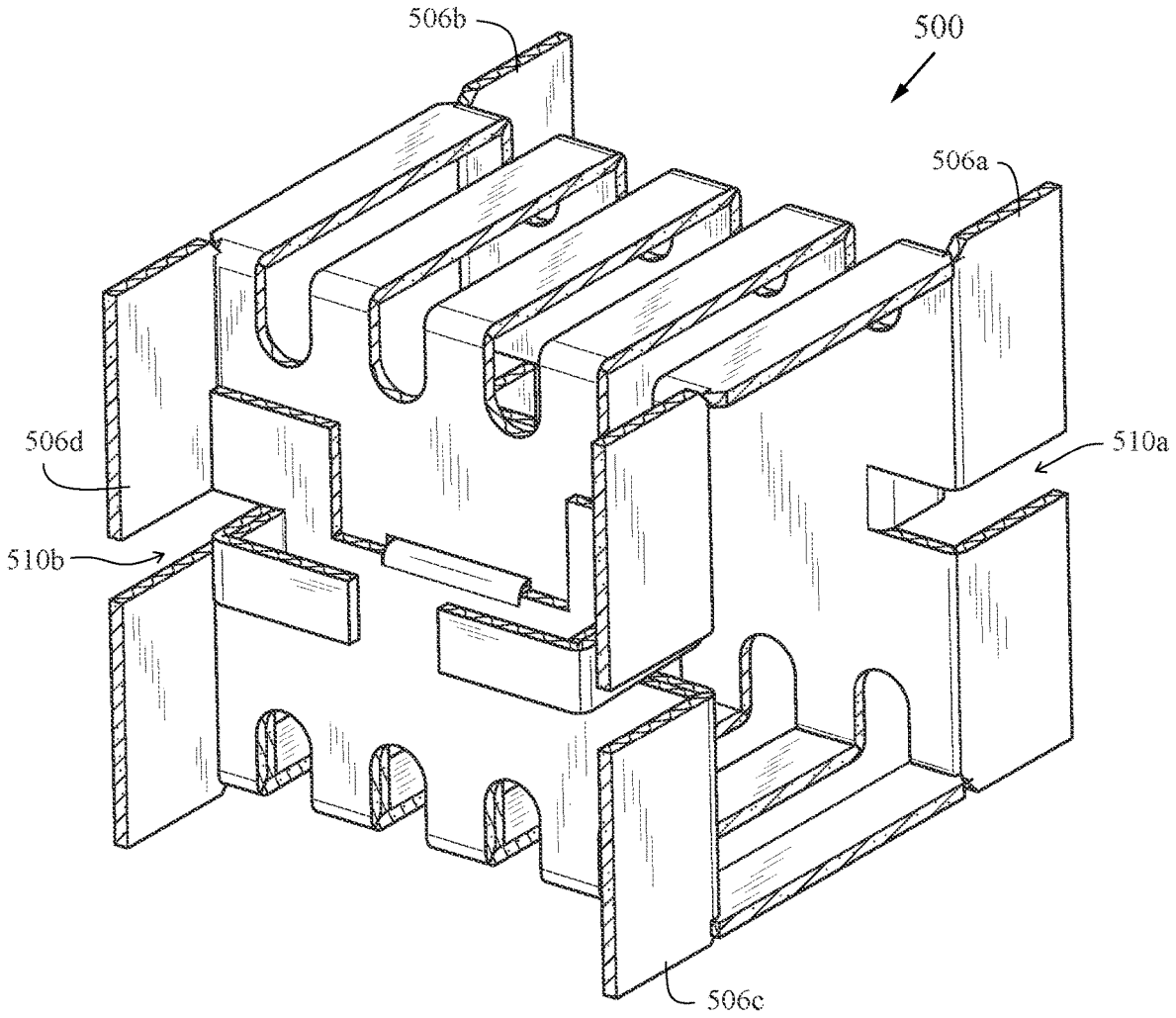
FIG. 16 is a top perspective view of the central divider for the box for irons for ten pieces.
Figure 17:
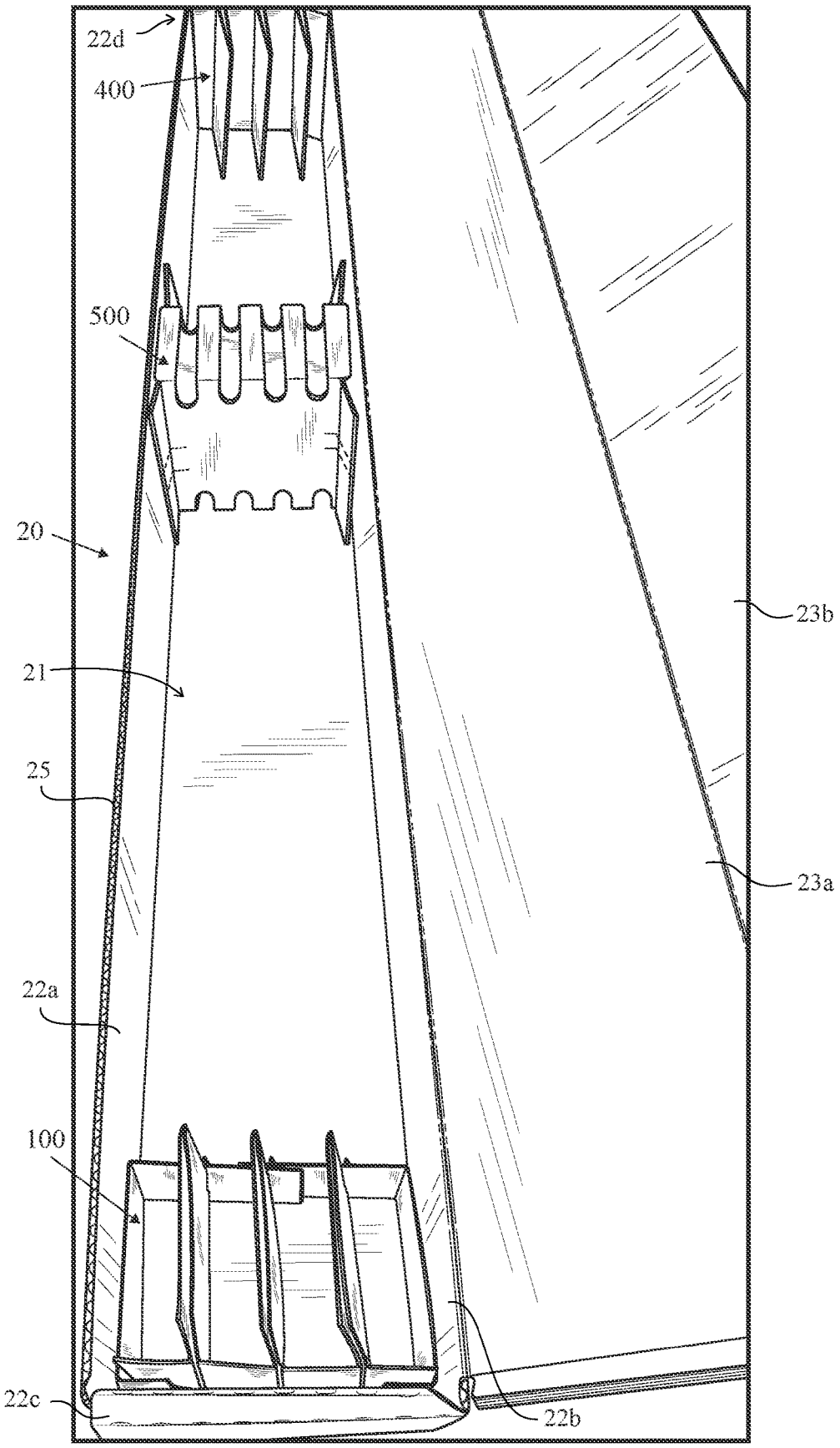
FIG. 17 is a top perspective view of an open box with the first lateral divider, the second lateral divider and the central divider placed therein.

FIGS. 11-16 illustrate a central divider 500. The central divider 500 comprises of a cover panel 501, a lock 502, a lock slot 507, slot panel walls 503*a*-503*b*, slots 509*a*-509*d*, side panels 506*a*-506*d*, and central panels 505*a*-505*b*. FIG. 15 illustrates a central divider 500 assembled for eight pieces. FIG. 16 illustrates a central divider 500 assembled for ten pieces. Detaching pre-cut flaps from panels 506*a*-506*d* reveals two more spaces 510*a*-510*b*. Each central panel 505 preferably has a height ranging from 3 to 5 inches, and most preferably 4.125 inches. A width is preferably 3 to 5 inches and most preferably 4.25 inches. The slot panels 503 preferably have a width ranging from 2.75 inches to 4.0 inches, and most preferably approximately 3 inches.

FIGS. 17-20 illustrate a box 20 with iron-type golf clubs 30 therein. The box 20 comprises of a body 25 with walls 22*a*-22*d* which create an elongated hollow interior 21 when assembled. The body 25 also includes a cover wall 23*a* and a cover front wall 23*b*. A first lateral divider 100 is positioned at a one end of the interior 21 of the body 25. A second lateral divider 400 is positioned at the other end of the interior 21 of the body 25. A central divider is positioned in the center of the interior 21 of the body 25.

Figure 18:
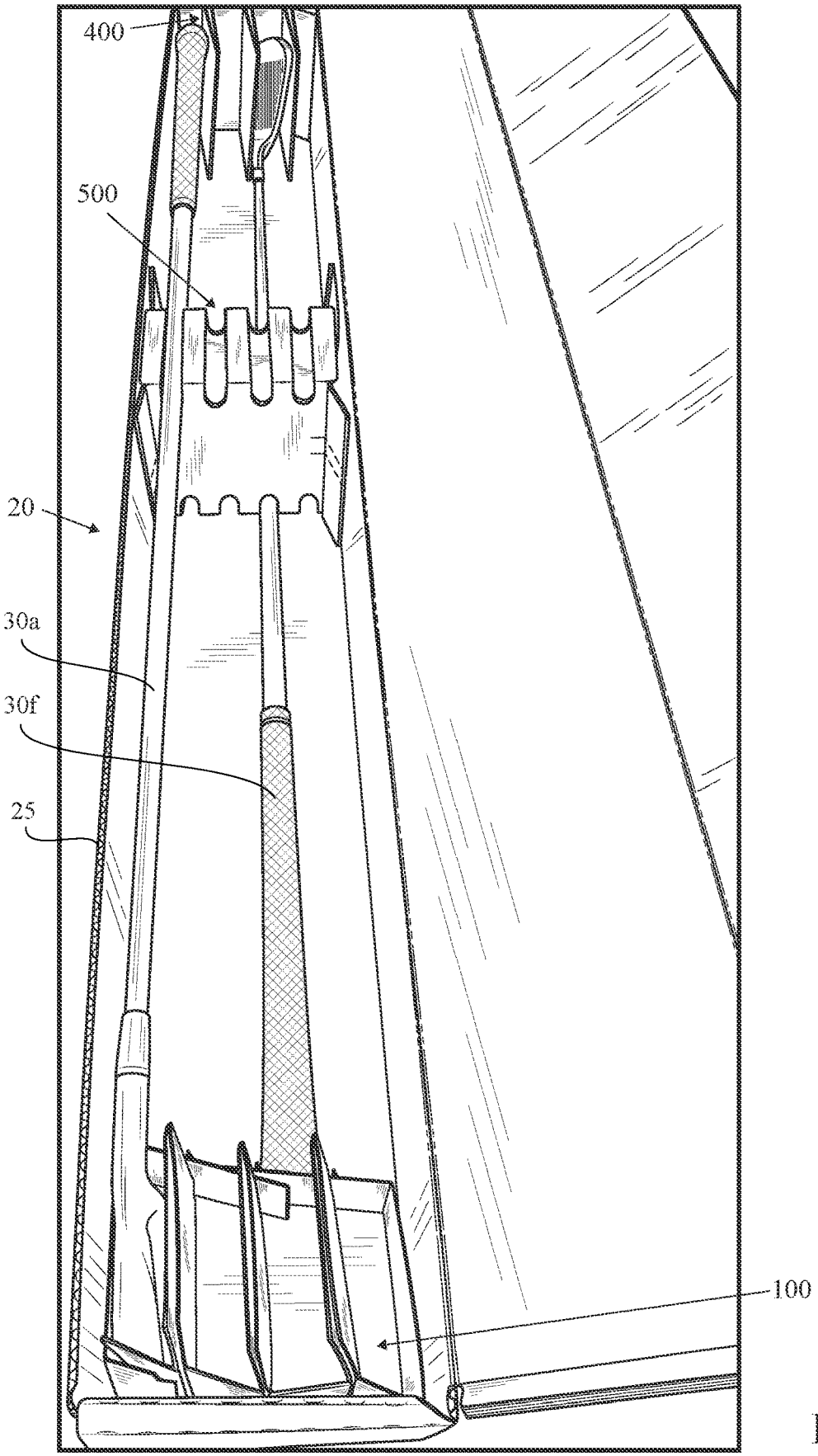
FIG. 18 is a top perspective view of an open box with the first lateral divider, the second lateral divider and the central divider placed therein, and a first iron and a second iron positioned within the first lateral divider, the second lateral divider and the central divider.

The box 20 is configured to house iron-type golf clubs positioned within the interior 21 and separated by the first lateral divider 100, the second lateral divider 400 and the central divider 500, as shown in FIGS. 18-19.

The box 20 preferably houses eight iron-type golf clubs with a club head end of the golf clubs 30 positioned on the first lateral divider 100, and the grip end of iron-type golf clubs positioned on the second lateral divider 400, as shown in FIGS. 19-20.

The body 25 of the box 20 is preferably composed of corrugated paperboard.

The length of the box 20 preferably ranges from 40 to 60 inches. The width of the box 20 preferably ranges from 3 to 5 inches.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A box for a set of iron-type golf clubs, the box comprising:

a body comprising a plurality of walls defining an elongated hollow interior and a cover wall;

a first lateral divider positioned at a first end of the elongated hollow interior of the body, the first lateral divider comprising a plurality of back panel walls, a plurality of central panel walls, and a plurality of external panel walls, wherein each central panel has a length ranging from 2.5 to 3.5 inches;

a second lateral divider positioned at a second end of the elongated hollow interior of the body, the second lateral divider comprising a plurality of back panels and a plurality of central panels, wherein each central panel has a length ranging from 3 to 5 inches and each back panel has a length ranging from 0.75 inch to 1.5 inches;

a central divider positioned at a center of the elongated hollow interior of the body, wherein the central divider comprise a cover panel, a lock, a lock slot, a plurality of slot panel walls, a plurality of slots, a plurality of side panels and a plurality of central panels, wherein the slot panels have a width ranging from 2.75 inches to 4.0 inches;

wherein a width of the box ranges from 3 to 5 inches;

wherein a length of the box ranges from 40 to 60 inches.

2. The box according to claim 1 wherein the box is configured to receive a plurality of iron-type golf clubs positioned within the elongated hollow interior and separated by the first lateral divider, the second lateral divider and the central divider.

3. The box according to claim 2 wherein the box is configured to receive plurality of iron-type golf clubs is eight iron-type golf clubs with a club head end of iron-type golf clubs positioned on the first lateral divider, and the grip end of iron-type golf clubs positioned on the second lateral divider.

4. The box according to claim 1 wherein the body is composed of corrugated paperboard.

* * * * *